US010598320B2

(12) United States Patent
Catalano et al.

(10) Patent No.: US 10,598,320 B2
(45) Date of Patent: Mar. 24, 2020

(54) INTEGRAL COOLING FOR LED LIGHTING SOURCE

(71) Applicant: LEDVANCE LLC, Wilmington, MA (US)

(72) Inventors: Anthony W. Catalano, Boulder, CO (US); Christopher White, Frederick, CO (US)

(73) Assignee: LEDVANCE LLC, Wilmington, MA (US)

( * ) Notice: Subject to any disclaimer, the term of this patent is extended or adjusted under 35 U.S.C. 154(b) by 0 days.

(21) Appl. No.: 14/789,357

(22) Filed: Jul. 1, 2015

(65) Prior Publication Data

US 2016/0178180 A1 Jun. 23, 2016

Related U.S. Application Data

(60) Provisional application No. 62/020,230, filed on Jul. 2, 2014.

(51) Int. Cl.

| | |
|---|---|
| ***F21S 8/02*** | (2006.01) |
| ***F21V 23/00*** | (2015.01) |
| ***F21V 29/503*** | (2015.01) |
| ***F21V 29/508*** | (2015.01) |
| ***F21V 29/67*** | (2015.01) |
| ***F21V 29/76*** | (2015.01) |
| *F21V 29/61* | (2015.01) |
| *F21Y 115/10* | (2016.01) |

(52) U.S. Cl.

CPC ..... *F21S 8/026* (2013.01); *F21V 23/008* (2013.01); *F21V 29/503* (2015.01); *F21V 29/508* (2015.01); *F21V 29/67* (2015.01); *F21V 29/763* (2015.01); *F21V 29/61* (2015.01); *F21Y 2115/10* (2016.08)

(58) Field of Classification Search

CPC ..... F21S 8/026; F21V 29/503; F21V 29/508; F21V 29/67; F21V 29/763; F21V 29/673; F21V 29/61; F21V 23/008

USPC ..... 362/373

See application file for complete search history.

(56) References Cited

U.S. PATENT DOCUMENTS

| | | | | |
|---|---|---|---|---|
| 6,095,671 | A * | 8/2000 | Hutain | F21S 2/00 362/373 |
| 8,287,142 | B2 * | 10/2012 | Pickard | F21S 8/026 362/148 |
| 2002/0157324 | A1 * | 10/2002 | Newbold | F21S 8/02 52/27 |
| 2009/0080189 | A1 * | 3/2009 | Wegner | F21S 8/02 362/235 |
| 2010/0176746 | A1 * | 7/2010 | Catalano | G01K 7/01 315/297 |
| 2011/0110108 | A1 * | 5/2011 | Calon | F21V 29/02 362/373 |

(Continued)

*Primary Examiner* — Elmito Breval

(74) *Attorney, Agent, or Firm* — Neugeboren O'Dowd; Tutunjian & Bitetto PC; Timothy Durken

(57) ABSTRACT

An illumination device comprises a lighting module that itself includes one or more LEDs; a driver module, physically separate from the lighting module, and comprising for supplying power to the one or more LEDs; a flexible conduit electrically connecting the driver module to the lighting module; an air pathway following the conduit; and a cooling facility for directing air through the lighting module and the driver module, such that the air passes through the air pathway.

13 Claims, 3 Drawing Sheets

(56) References Cited

U.S. PATENT DOCUMENTS

| | | | | |
|---|---|---|---|---|
| 2012/0104951 | A1* | 5/2012 | Taubert | H05B 41/02 315/117 |
| 2012/0120635 | A1* | 5/2012 | Strong | F21V 21/084 362/105 |
| 2013/0128589 | A1* | 5/2013 | Kim | F21S 8/026 362/294 |

* cited by examiner

INTEGRAL COOLING FOR LED LIGHTING SOURCE

CROSS-REFERENCE TO RELATED APPLICATION

This application claims priority to and the benefit of U.S. Provisional Patent Application No. 62/020,230, filed on Jul. 2, 2014, the entire disclosure of which is hereby incorporated herein by reference

FIELD OF THE INVENTION

In various embodiments, the present invention relates to illumination devices, in particular illumination devices incorporating light-emitting diodes (LEDs).

BACKGROUND

One of the most common light fixtures is the recessed can downlight (RCD), which is an open-bottom can that contains a lightbulb, most commonly an incandescent bulb or a fluorescent bulb. The fixture is typically connected to the power mains at 120 to 277 volts, 50/60 Hz. RCDs are generally installed during the construction of a building before the ceiling material (such as plaster or gypsum board) is applied. Therefore, they are not easily removed or substantially reconfigured during their lifetime.

RCDs generally also accommodate lightbulbs having various sizes, different overall dimensions (i.e., length, width, and diameter), and varied light-distribution capabilities. For example, various bulbs have narrow, medium, or wide (flood) light distributions. Therefore, the internal features of the RCD are constructed to accommodate many (if not all) different bulb types. Such features include mechanisms to adjust the vertical position of the bulb socket, as well as reflectors that channel and distribute the light. Because there are so many different lightbulbs and finishes, a very large number of trim rings and optics combinations may be utilized in RCDs, in addition to the various spacers that accommodate the bulbs. Thus a complex arrangement of parts is needed for each RCD that is produced.

Because LEDs have very high efficiency (e.g., 100 lumens per watt compared to 10-15 lumens per watt for incandescent or halogen lights) and a long lifetime (e.g., 10,000-100,000 hours), they are attractive for virtually all lighting applications. LED retrofit fixtures have been designed to replace existing, installed RCD fixtures. U.S. Ser. No. 14/660,159, filed on Mar. 17, 2015, for example, describes a retrofit kit that enables retrofitting of a wide variety of different RCDs (e.g., RCDs incorporating fluorescent bulbs) with a single "universal" LED-based fixture that is quickly and efficiently installable. Within the retrofit kit, the LED light sources and control electronics are modularized for ease of assembly and installation. In addition, the retrofit kit may be utilized substantially independently of the specific lightbulb being replaced yet conforms to the volume and desired level of illumination of the existing RCD.

A retrofit kit as described in the '801 application may include a discrete driver module featuring circuitry for supplying power to and controlling the LED light source(s), as well as, in various embodiments, circuitry for controlling the LEDs based on sensed temperature (for example, the temperature of the LEDs themselves or of one or more temperature sensors such as thermistors in close proximity to the LEDs). The driver module is electrically connected to a discrete lighting module featuring one or more LEDs (for example, several LEDs arranged in a rectilinear array) via a flexible conduit that contains and protects one or more wires carrying electrical signals between the two modules. The lighting module may incorporate one or more temperature sensors for sensing the temperature of the LED(s) and/or the ambient temperature, and the driver module may incorporate thermal-feedback circuitry for controlling power supply to the LED(s) based on the sensed temperature. The lighting module also typically incorporates an integral or removable heat sink.

Unfortunately, the high power levels often required to drive an LED retrofit solution to maintain previous lighting levels may generate so much heat that merely heat-sinking the LEDs can prove insufficient. LED lifetime can be substantially shortened by excessive operating temperatures; in general, it is advisable to maintain the LED below 100° C. during operation. Indeed, even where such passive measures as finned heat sinks are sufficient from a performance perspective, they may be incompatible with the physical restrictions of a retrofit; the volume within a light source such as an RCD is limited, and the airflow needed for effective heat sinking may be impossible within the fixture space. Even when there is adequate room for a large heat sink, it may displace the light source so as to create glare and ultimately impose a cap on light output. For example, it may be necessary to change the configuration to position the LEDs lower in the can, resulting in an out-of-focus condition for the LEDs and/or considerable visual glare, which is highly undesirable. Placing the heat sink outside the can (reflector) also is usually not possible due to the mounting and support structure of the light fixture. Moreover, the region above the can may be filled with insulation and the building's structural elements, such as rafters and beams, may either restrict airflow or make the use of the space impossible.

SUMMARY

The present invention is directed toward the problem of dissipating heat from LEDs within a confined space. Embodiments of the invention address this problem simplifying active cooling or "enhanced" passive cooling.

Accordingly, in a first aspect, the invention pertains to an illumination device. In various embodiments, the illumination device comprises a lighting module comprising one or more LEDs; a driver module, physically separate from the lighting module, and comprising circuitry for supplying power to the one or more LEDs; a flexible conduit electrically connecting the driver module to the lighting module; an air pathway following the conduit; and a cooling facility for directing air through the lighting module and the driver module, such that the air passes through the air pathway. In some embodiments, the pathway is through the conduit. For example, the device may further comprise a duct coaxially surrounding the conduit, with the pathway running through the coaxial duct. Alternatively, the device may further comprise a duct adjacent to the conduit, with the pathway running through the adjacent duct.

In some embodiments, the cooling facility is powered by the driver module. The cooling facility may consist of or comprise a fan, which may be disposed in the lighting module, the driver module, between the lighting and driver modules, or outside both modules. In some embodiments, the fan is configured to draw air through one of the modules and blow air through the other module.

The device may further comprise a sensor for sensing a temperature of at least one of the LEDs, and a controller, operatively coupled to the sensor, for controlling operation of the cooling facility based at least in part on the sensed temperature.

The term "substantially" or "approximately" means±10% (e.g., by weight or by volume), and in some embodiments, ±5%. The term "consists essentially of" means excluding other materials that contribute to function, unless otherwise defined herein. Nonetheless, such other materials may be present, collectively or individually, in trace amounts. Reference throughout this specification to "one example," "an example," "one embodiment," or "an embodiment" means that a particular feature, structure, or characteristic described in connection with the example is included in at least one example of the present technology. Thus, the occurrences of the phrases "in one example," "in an example," "one embodiment," or "an embodiment" in various places throughout this specification are not necessarily all referring to the same example. Furthermore, the particular features, structures, routines, steps, or characteristics may be combined in any suitable manner in one or more examples of the technology. The headings provided herein are for convenience only and are not intended to limit or interpret the scope or meaning of the claimed technology.

BRIEF DESCRIPTION OF THE DRAWINGS

The foregoing will be more readily understood from the following detailed description of the invention, in particular, when taken in conjunction with the drawings, in which.

DETAILED DESCRIPTION

Figure 1:
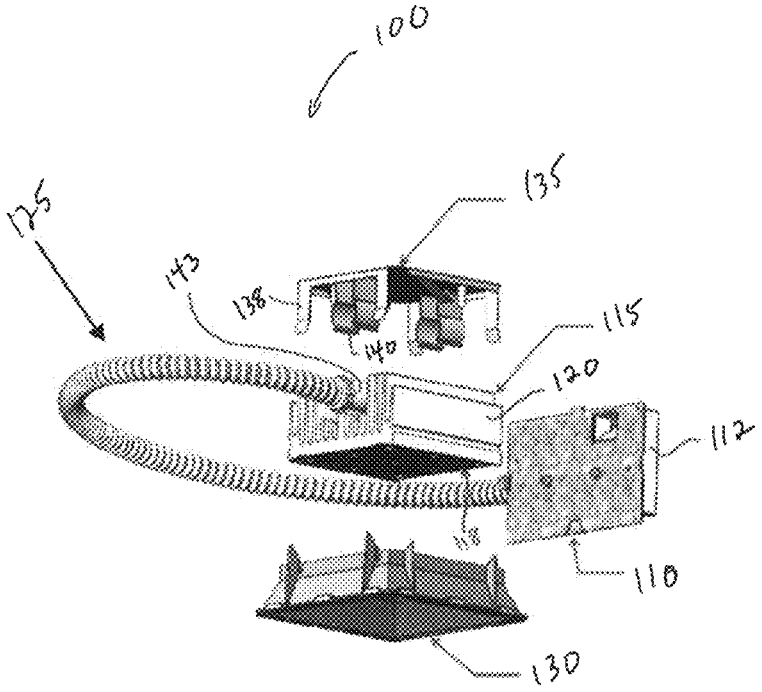
FIG. 1 is an exploded view of a lighting system in accordance with embodiments of the invention.

FIG. 1 illustrates a retrofit fixture assembly 100 for replacing a conventional RCD. The assembly 100 includes a driver module 110, which contains, within a typically metal housing 112, circuitry for controlling the operation of, and supplying power to, a plurality of LEDs in a physically separate and discrete lighting module 115. LED output emanates from a bottom surface 118 of the lighting module 115. A metal heat sink 120 is in contact with the LEDs to conduct heat therefrom and dissipate it by convection into the surrounding environment. Wires within a flexible conduit 125 electrically connect the LEDs to the circuitry in the driver module 110. A diffuser and light-mixing chamber 130 is configured to snap onto the bottom of the lighting module 115 so that light from the LEDs mixes and is directed downwardly in the manner of an RCD. The lighting module 115 is received within a mounting and alignment bracket 135, which is itself secured to a joist or other rigid ceiling structure. The bracket 135 may have a plurality of clips 138 that engage the sides of the heat sink and a pair of clamps 140 that receive a stiff tubular extension 143 of the flexible conduit 125, which is mounted to the top of the heat sink 120.

Figure 2:
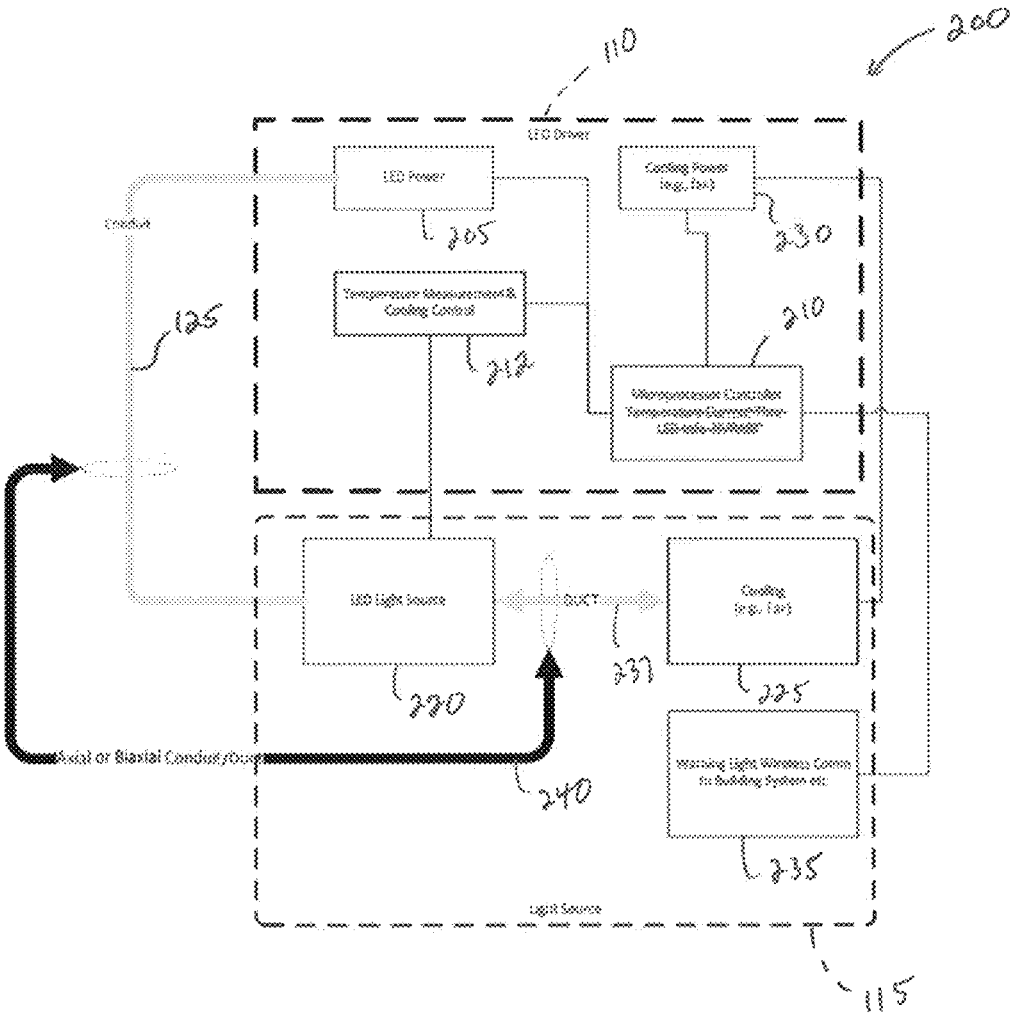
FIG. 2 schematically illustrates a representative cooling configuration in accordance with embodiments of the present invention.

Further details of the driver and lighting modules 110, 115 are illustrated in FIG. 2, which also shows an exemplary configuration 200 of a cooling arrangement in accordance herewith. The circuitry of the driver module 110 includes an LED power supply 205, which is typically a constant-current power source, and a controller 210. Separately or as part of the controller 210, the driver module 115 includes circuitry 212 for adjusting the power supplied to the LEDs 220. For example, a thermistor or other temperature-measurement device can be located in the lighting module 115 and provide a signal proportional to a sensed temperature to the temperature circuitry 212; the circuitry 212, in turn, may produce a signal both to the controller 210, which may reduce the power supplied to the LEDs 220 by the power supply 205, and to an active cooling device 225 (e.g., a fan or blower) via a power supply 230 therefor. The temperature circuitry 212 may control the intensity of cooling—e.g., the speed of a fan 225—by adjusting the amount of power provided by the cooling power supply 230 in response to the temperature signal. The temperature circuitry 212 can be programmed or configured to track time, temperature and drive current and compute an expected degradation for the light output and/or life of the LED. This result can be used to drive the fan and, if excessive, cause a warning signal to be given by an alert system 235 (e.g., turning on a light built into the fixture, providing a wireless signal that contains the information, etc.).

Alternatively, the decision making circuitry 212 and/or the cooling power supply 230 mechanism can lie within the heat sink or lighting module 115 itself. For example, a bi-metallic relay or switch in-line with the power to the cooling element 225 can respond to an excessive sensed temperature and provide power thereto.

Figure 3:
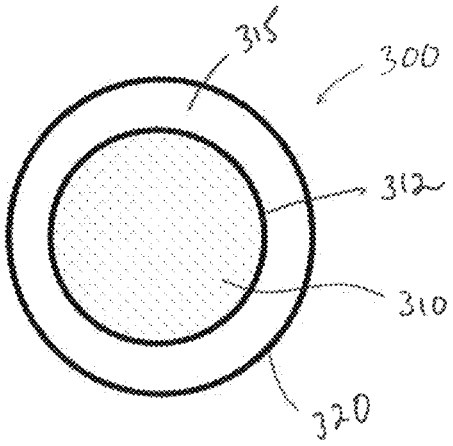
FIG. 3 is a sectional view of a combined electrical conduit and concentric air duct in accordance with embodiments of the present invention.

In the embodiment 200, the cooling element 225 is located in the lighting module and a duct 237 delivers the cooling air to the LEDs 220. A second duct 240, coextensive and, in some embodiments, coaxial with the conduit 125 delivers the air flow to the driver module 110. A representative coaxial arrangement is shown in FIG. 3. The duct-and-cable assembly 300 includes a central conduit portion 310, through which electrical cabling runs. Typically, the sleeve 312 defining the conduit 312 is a corrugated metal for fire protection. In some embodiments, the diameter of the conduit 310 is large enough relative to the electrical cabling passing therethrough that the conduit 310 itself can serve as the duct 240—i.e., there is enough open space within the conduit 310 that air can be forced through at a flow rate adequate for cooling. In other embodiments, a duct 315 defined by an outer sleeve 320 coaxially surrounds the conduit sleeve 312. The outer sleeve may 320 be much lighter in weight than the conduit sleeve 312; for example, the outer sleeve 320 may be a flexible plastic, and may be accordioned to accommodate bending. In other embodiments, the duct 315 is adjacent to (e.g., bi-axial with) the electrical conduit 310 rather than coaxial therewith, and once again may be made of plastic at least as flexible as the conduit sleeve 312.

Because active cooling usually involves forcing airflow or convection, it is convenient to provide the source of power 230 for this function within the driver module 110. However, because typical LED drivers exhibit relatively high energy efficiency (80-90% is typical), whereas the LEDs have an electrical-to-optical conversion efficiency of approximately 20%, it may be deemed preferable to locate the cooling element 225 in the driver module 110 rather than within the lighting module 115. This arrangement also avoids the need to run wires to power the cooling element 225 from driver module 110 to the lighting module 115.

Figure 4:
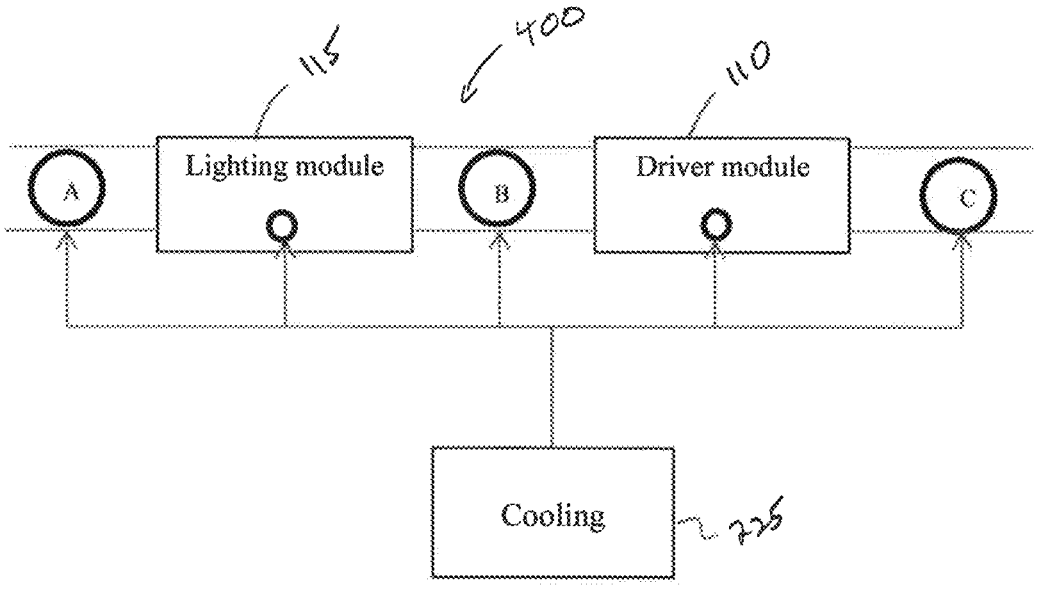
FIG. 4 schematically illustrates placement locations for a cooling unit in embodiments of the present invention.

As shown in FIG. 4, if the driver and lighting modules both require cooling, they can be considered as a series fluid circuit 400, and the cooling element 225 can be located anywhere along the circuit. Furthermore, a fan 225 can either blow air through the circuit 400 or draw air and exhaust it outside the circuit, or both. Thus, the cooling element 225 may be located at position A outside but in fluid communication with the lighting module 115, or, correspondingly, at position C outside but in fluid communication with the driver module 110—in either case blowing or drawing air through the entire circuit 400. Alternatively, the cooling element 225 may be located within either of the modules 110, 115, or between them at position B. In the latter case, a fan 225 may draw air through the module on one side and blow it through the module on the other side, thereby cooling both modules. Many configurations are possible within the applicable limitations of local building codes or UL regulations.

Other approaches to heat removal may also or alternatively be employed. One such approach is the use of a heat pipe containing a fluid that can be vaporized, thus transporting heat evaporatively. The heat is transferred to a cooler region where a radiator is located and released via condensation of the fluid. Heat pipes can be made very compact to fit within the envelope of a fixture. Moving the heat away from the LEDs 220 allows a fan or other cooling facility to exhaust the released heat to the environment using the power provided by the LED driver.

The controller 210 and temperature circuitry 212, or processing unit that executes the relevant commands and instructions, may be a general-purpose computer processor, but may utilize any of a wide variety of other technologies including a CSIC (customer-specific integrated circuit), ASIC (application-specific integrated circuit), a logic circuit, a digital signal processor, a programmable logic device such as an FPGA (field-programmable gate array), PLD (programmable logic device), PLA (programmable logic array), RFID processor, smart chip, or any other device or arrangement of devices that is capable of implementing the steps of the processes of the invention.

The programming necessary to achieve the functionality described above is straightforwardly implemented by those skilled in the art without undue experimentation. The controller itself may be implemented in hardware, as described above, in software or as a combination of the two. For embodiments in which functionality is provided as one or more software programs, the programs may be written in any of a number of high level languages such as FORTRAN, PASCAL, JAVA, C, C++, C #, BASIC, various scripting languages, and/or HTML. Additionally, the software can be implemented in an assembly language directed to the microprocessor resident on a target computer; for example, the software may be implemented in Intel 80x86 assembly language if it is configured to run on an IBM PC or PC clone. The software may be embodied on an article of manufacture including, but not limited to, a floppy disk, a jump drive, a hard disk, an optical disk, a magnetic tape, a PROM, an EPROM, EEPROM, field-programmable gate array, or CD-ROM. Embodiments using hardware circuitry may be implemented using, for example, one or more FPGA, CPLD or ASIC processors.

The terms and expressions employed herein are used as terms and expressions of description and not of limitation, and there is no intention, in the use of such terms and expressions, of excluding any equivalents of the features shown and described or portions thereof. In addition, having described certain embodiments of the invention, it will be apparent to those of ordinary skill in the art that other embodiments incorporating the concepts disclosed herein may be used without departing from the spirit and scope of the invention. In particular, embodiments of the invention need not include all of the features or have all of the advantages described herein. Rather, they may possess any subset or combination of features and advantages. Accordingly, the described embodiments are to be considered in all respects as only illustrative and not restrictive.

What is claimed is:

1. A retrofit illumination fixture device comprising:

a lighting module comprising one or more LEDs, and a heat sink;

a mounting and alignment bracket coupled to the heat sink, the mounting and alignment bracket configured for rigid attachment to a building;

a driver module, physically separate from the lighting module, and comprising circuitry for supplying power to the one or more LEDs;

a flexible conduit containing an interior hollow tube for a wire chase, and an exterior hollow tube for an air pathway that is positioned encircling the interior hollow tube for the wire chase, and one or more electrical connection wires within the interior hollow tube for that is for the wire chase electrically connecting the driver module to the lighting module, wherein the interior hollow tube for the wire chase is comprised of a corrugated metal; and a fan for directing air through the lighting module and the driver module, the air passing through the air pathway of the flexible conduit.

2. The retrofit illumination fixture device of claim 1, wherein the fan is powered by the driver module.

3. The retrofit illumination fixture device of claim 1, further comprising:

a sensor for sensing a temperature of at least one of the LEDs; and a controller, operatively coupled to the sensor, for controlling operation of the fan based at least in part on the sensed temperature.

4. The retrofit illumination fixture device of claim 3, wherein the driver module and the sensor are configured to track time, a temperature of the LED, and a drive current of at least one of the LEDs.

5. The retrofit illumination fixture device of claim 4, wherein the controller controls operation of the fan based on a calculated expected degradation of a light output or life of at least one of the LEDs.

6. The retrofit illumination fixture device of claim 1, wherein the fan is disposed in the lighting module.

7. The retrofit illumination fixture device of claim 1, wherein the fan is disposed in the driver module.

8. The retrofit illumination fixture device of claim 1, wherein the fan is disposed between the lighting module and the driver module.

9. The retrofit illumination fixture device of claim 1, wherein the fan is disposed outside both of the modules.

10. The retrofit illumination fixture device of claim 1, wherein the fan is configured to draw air through one of the modules and blow air through the other module.

11. The retrofit illumination fixture of claim 1, wherein the mounting and alignment bracket couples to the flexible conduit.

12. The retrofit illumination fixture of claim 11, wherein the mounting and alignment bracket couples to the flexible conduit via one or more arcuate clamps.

13. A retrofit fixture assembly for replacing a recessed can downlight (RCD) comprising:

a lighting module comprising one or more LEDs;

a driver module, physically separate from the lighting module, and comprising circuitry for supplying power to the one or more LEDs;

a flexible conduit comprising a corrugated metal hollow tube and one or more electrical connection wires within the corrugated metal hollow tube for electrically connecting the driver module to the lighting module;

a second flexible hollow tube coaxially surrounding the flexible conduit comprising the corrugated metal hollow tube to provide that the flexible conduit comprising the corrugated metal hollow tube is inside the second flexible hollow tube, and a fan mounted within the driver module for directing air through the second flexible hollow tube being pulled from the lighting module to the driver module for cooling both of the driver module and the lighting module, wherein the corrugated metal hollow tube protects the metal electrical wires from heat from the air being directed through the second flexible hollow tube during operation of said retrofit fixture assembly for replacing said recessed can downlight (RCD).

* * * * *